United States Patent [19]

Anderson et al.

[11] Patent Number: 4,989,479

[45] Date of Patent: Feb. 5, 1991

[54] PLIER JAWS

[75] Inventors: Alan D. Anderson; Roland C. White, both of Sumter, S.C.

[73] Assignee: Cooper Industries, Inc., Houston, Tex.

[21] Appl. No.: 430,881

[22] Filed: Nov. 2, 1989

[51] Int. Cl.[5] ..... B25B 7/02

[52] U.S. Cl. ..... 81/424.5; 81/186; 81/418

[58] Field of Search ..... 81/424.5, 426.5, 367–380, 81/186, 120, 418

[56] References Cited

U.S. PATENT DOCUMENTS

| | | | |
|---|---|---|---|
| 458,934 | 9/1891 | Barden | 81/424.5 X |
| 1,437,873 | 12/1922 | Terry | 81/186 X |
| 2,563,267 | 8/1951 | Petersen | 81/424.5 |
| 3,894,451 | 7/1975 | Putsch | 81/424.5 |
| 4,546,680 | 10/1985 | Petersen | 81/418 X |

FOREIGN PATENT DOCUMENTS

| | | | |
|---|---|---|---|
| 4078 | of 1885 | United Kingdom | 81/424.5 |

*Primary Examiner*—D. S. Meislin

*Attorney, Agent, or Firm*—Ned L. Conley; David A. Rose; William E. Shull

[57] ABSTRACT

A locking plier having a pair of opposed, pivotable work-gripping jaws with facing curved portions on each jaw between the tip and the pivot, and transverse work-gripping teeth in the curved portion of each jaw, the face of the teeth in the curved portion of one jaw which faces toward the handle being at an angle of from about 75° to about 85° to the primary form centerline, and the face of the teeth in the curved portion of the other jaw which faces away from the handle being at an angle of from about 75° to about 85° to the primary form centerline, each such tooth having an included angle of from about 45° to about 90°.

2 Claims, 2 Drawing Sheets

PLIER JAWS

This invention relates in general to plier jaw designs, and more particularly to tooth configurations for a plier jaw.

BACKGROUND OF THE INVENTION

Pliers are so universally used that almost all persons, from the housewife to the skilled artisan, use them from time-to-time. Because of the wide use of these tools, many modifications and variations have been made. They have varied from comparatively small tools with long slender jaws for delicate work to large locking and clamping tools for heavy duty machinery. Moreover, the jaws have taken many forms and shapes, including C-shaped jaw members, straight jaws, curved jaws, pinch-off jaws, elongated flat plate-like jaws for sheet metal work, welding clamp jaws, and movable jaw members coupled with a chain clamping means enabling a workpiece such as a pipe to be effectively gripped.

One of the purposes for which pliers are commonly used is for applying a torque to a workpiece such as a pipe or rod, either to cause the workpiece to rotate about its axis, or to resist rotation of the workpiece about its axis. To accomplish this, two kinds of force are required—a gripping force to grip the workpiece and a rotative force. Pliers used for this purpose preferably have teeth formed on a curved or arcuate jaw so that the opposing jaws provide curved portions for gripping a cylindrical workpiece, or for gripping corners of a polygonal workpiece. These curved portions generally have transverse gripping teeth to engage and bite into the workpiece when a gripping force is applied to the plier. Then when a rotative force is applied to the plier handle, the frictional resistance generated by the engagement of the teeth with the workpiece resists relative rotation so that a torsional force is applied to the workpiece. The greater the gripping force applied, the greater the frictional resistance, and the greater the torque which may be exerted to cause or to prevent rotation of the workpiece.

Pliers may be classified as either locking pliers or non-locking pliers. In a non-locking plier, the gripping force is applied by the hand of the user, and the amount that may be applied is directly related to the user's strength, whereas locking jaw pliers grip the workpiece with brute force generated and applied through the mechanical advantage of a locking toggle mechanism and frame. Once established, the grip is maintained as a result of the toggle mechanism locking past center, and the user of the plier can then apply a rotational force on the workpiece. The degree to which the tool grips, and is able to transfer torque to the workpiece, is highly dependent upon the design of the toggle mechanism of the tool. Locking pliers are shown for example in Petersen U.S. Pat. No. 2,563,267 and in Petersen U.S. Pat. No. 4,546,680. Such locking pliers are capable of applying a much higher gripping force than a user can apply to an ordinary plier, so a much higher torsional force can be applied to the workpiece before the plier slips.

When such prior art pliers are used to apply a torque to a cylindrical workpiece, it will be appreciated that the amount of torque generated is dependent in part on the amount of friction between the teeth of the plier and the workpiece. The application of force through the teeth causes them to bite into the workpiece, thereby causing small depressions in the workpiece to increase the amount of friction. The teeth in prior art pliers have generally been symmetrical, i.e. both faces of the teeth are at substantially the same angle with the surface of the work being gripped, with a total included angle of from about 80° to about 100°. Smaller angles are generally undesirable because the teeth are made weaker. Such jaw tooth designs grip and allow torsional load application equally in both directions due to the symmetrical tooth profile pattern. However, because of the large included angle which must be used to avoid weakened teeth, no more than about 70% of the force applied to the plier is applied radially to the work, with the remainder of the rotational force being applied tangentially, thereby tending to counteract the gripping force and induce slippage. Thus, with even moderate gripping pressures the teeth can cam or tear out of the surface of stubborn objects, causing damage to the workpiece or injury to the user.

To prevent such slippage the user of a locking plier adjusts the plier to grip tighter. This means he has to squeeze the plier handles together with more pressure to cause the handles to come together and the toggle mechanism to lock past center.

Asymmetrical teeth have previously been used on a straight jaw non-locking plier, as illustrated in the drawing at FIGS. 4 and 5, to reduce the tendency of the teeth to slip. However, at best a straight jaw plier can grip a cylindrical workpiece with only two teeth of each jaw, so a gripping force sufficient to prevent slippage, such as may be applied with locking pliers, may result in undesirable damage to the surface of the workpiece. In addition, the use of asymmetrical teeth on a straight jaw reduces the width of the base of the teeth, so that they are weaker than symmetrical teeth and are more likely to be damaged in use. This problem, also, is accentuated with the higher gripping force which is possible with locking pliers.

SUMMARY OF THE INVENTION

It is an object of the present invention to provide locking pliers which have a radially-displaced angularly-biased non-symmetrical gripping tooth profile design to allow the transfer of higher torque loads with the gripping forces used in the prior art.

It is another object of the invention to reduce the slippage of locking pliers on the workpiece and transfer more torque to the workpiece with the same amount of gripping force applied to conventional locking plier designs.

It is a further object to provide a locking plier in which more usable torque can be obtained with the same or reduced gripping force, thereby avoiding unnecessarily high gripping forces and reducing damage to the workpiece and potential for damage to the plier and injury to the user.

These and other objects of the invention are provided by a curved jaw plier which has a non-symmetrical gripping tooth profile. The profile is such as to allow more rotational force to be transferred to the workpiece in planes that more precisely approach the optimum angle for force transfer and torque generation from multiple teeth over a wide range of workpiece diameters. The profile design of this invention causes rotational force to be directed at an angle which more closely approximates the optimum force transfer angle, which is tangent to the workpiece diameter. As the gripping force transfer plane approaches perpendicular to tangent, the resultant force vector approaches the tangent to the workpiece, maximizing torque generation from the applied force, and minimizing the likelihood of slipping.

According to the invention, one plier jaw has teeth in the curved gripping portion in which that face of each tooth which is facing toward the handle of the plier is at a angle of from 60° to 110° to the primary tooth form center line, and the other plier jaw has teeth in the curved gripping portion in which that face of each tooth which faces away from the handle of the plier is at an angle of from 60° to 110° to the primary tooth form center line. The primary tooth form centerline is a straight line between the pivot of the plier and the point of contact of the tips of the jaws of the plier. The teeth have an included tooth profile angle within the range of from about 45° to about 75°.

With this tooth profile, when the plier is used to grip a workpiece, and a rotational force is applied in the direction of the front faces of the teeth which are nearly perpendicular to a tangent to the workpiece, the rotational force is applied to the workpiece in a nearly tangential direction. With the front or contact face angle at 80° to the tangent, the tangential vector is 98.5% of the total applied rotational force. This provides at least a 10–15% and as much as a 30% improvement over conventional pliers which are presently in the marketplace. For optimum rotational force transfer a tooth form with a force angle transfer plane at or close to 90° to the tangent would be preferred, and may be used in designs in which a lower tooth strength is acceptable. However, the use of a 90° transfer plane provides only a slight increase in force transfer efficiency from 98.5% to 100%, usually insufficient difference to justify the risk of incurring premature tooth form failure.

At an angle of as little as 60° the tangential vector is 86.6% of the total applied rotational force, still significantly greater than that obtained with a conventional tooth profile. On the other hand, a back angle, greater than 90°, could also be used, increasing the tendency of the teeth to bite into the workpiece while still allowing the conversion of nearly all of the applied rotational force to a tangential force. However, the use of a back angle will result in a substantially weaker tooth, so the applications for this modification will be limited.

BRIEF DESCRIPTION OF THE DRAWINGS

Embodiments of the present invention are illustrated in the accompanying drawings wherein.

DESCRIPTION OF THE PREFERRED EMBODIMENTS

Figure 1:
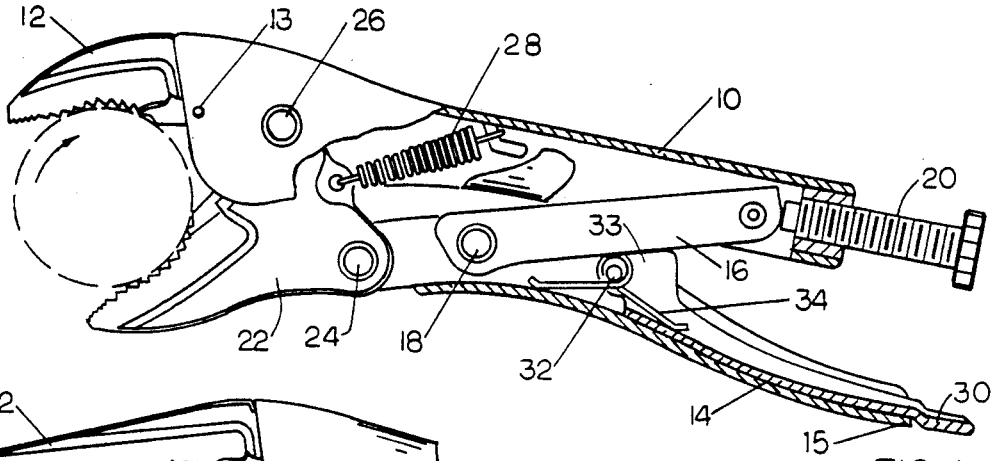
FIG. 1 is an elevational view of a locking plier incorporating one embodiment of the invention.

The locking plier shown in FIG. 1 includes an upper handle member 10 having a stationary upper jaw 12 attached to it. The handle member is preferably channel shaped in cross-section, and a portion of the jaw fits within the channel, and is fixedly secured therein, as by means of a pair of indentations 13 in the enclosing portions of the handle which fit into corresponding dimples in the jaw (not shown). A lower handle member 14 is preferably channel-shaped in cross-section, with an open end 15, and receives within the channel one end of a toggle link 16 which is pivotally attached to the lower handle member by pin 18. The other end of the toggle link is slidably received in the bottom of the channel of the upper handle member 10. An adjustment screw 20 is received within the end of the upper handle member and the end of the adjustment screw bears against the free end of the toggle link 16.

The lower handle member is pivotally attached to a movable lower jaw 22 by means of a pin 24. The lower jaw is also pivotally attached to the upper handle member by means of a pin 26. An extension coil spring 28 extends between the upper handle member and the lower jaw, engaging the lower jaw between the pivot pins 24 and 26, to bias the lower jaw 22 away from the stationary upper jaw 12 when the jaws are not locked.

An elongated release lever 30 is pivotally mounted by means of a pin 32 extending through one end of the lever, within the channel of handle member 14. This end of the lever is provided with a cam 33 which engages the toggle link 16 between the pivot pin 18 and the point of engagement of the toggle link with the fixed handle 10. The other end of the lever 30 extends past the open end 15 of the lower, movable handle 14.

A torsion spring 34 positioned around the pin 32 has one free end bearing against the handle member 14 and the other free end bearing against the release lever 30 to bias the release lever toward the handle member as illustrated in the drawing.

Figure 3:
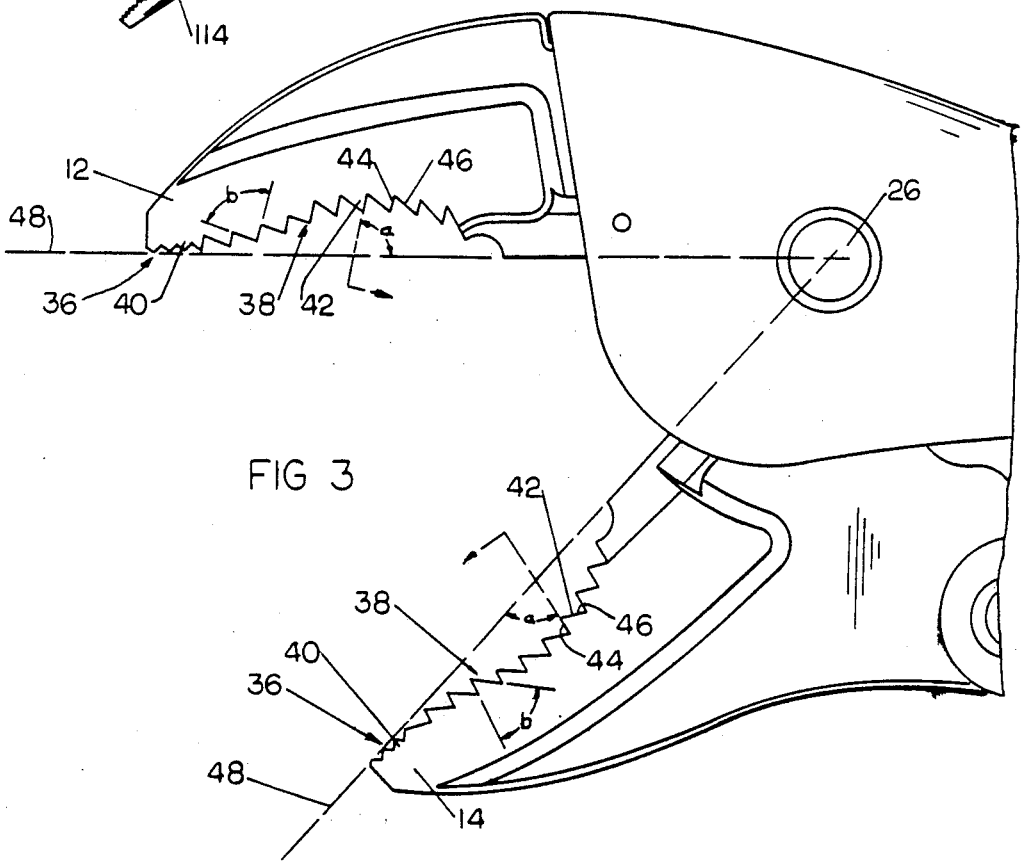
FIG. 3 is an enlarged fragmentary view showing the jaw portion of a plier incorporating an embodiment of the tooth profile of this invention.
Figure 4:
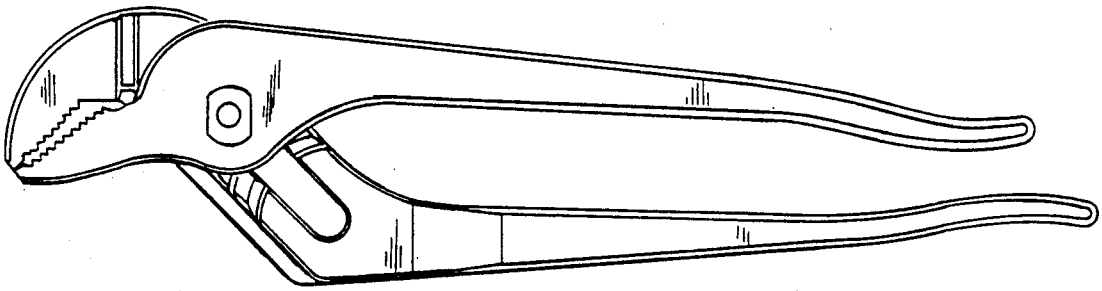
FIG. 4 PRIOR ART
FIG. 4 is an elevational view of a prior art plier.
Figure 5:
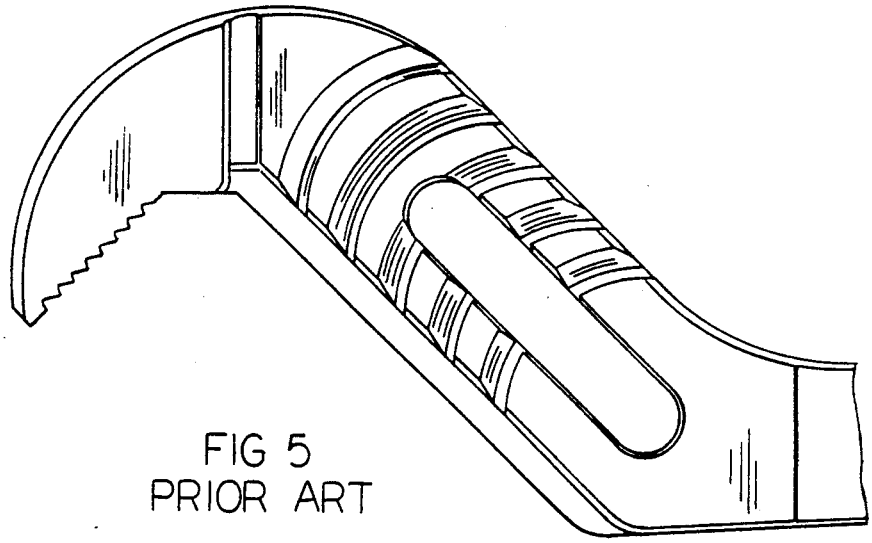
FIG 5 PRIOR ART
FIG. 5 is a fragmentary view showing the jaw and teeth of the prior art plier of FIG. 4.

Referring now to FIG. 3, the jaws incorporating the tooth profile of this invention are shown enlarged for better understanding of the tooth profile. As shown, the opposed gripping faces of the jaws include a short straight segment 36 at the tips of the jaws and a longer curved section 38 between the straight segment and the base of each jaw. According to this invention, the straight section may be provided with small symmetrical teeth 40 as shown, or with knurling or other desired gripping surface. The curved portion of the jaws, however, is provided with non-symmetrical teeth 42. The major portion of the curved portion is arcuate in form, but a reverse-curved transitional segment may be provided between the arcuate segment and the straight segment. This transitional segment not only smoothes the transition from the straight segment to the arcuate segment, but also allows the plier to grip larger cylindrical workpieces.

The non-symmetrical teeth 42 have a front or contact surface 44 which is at a substantially steeper angle than the back surface 46 of each tooth. The front surfaces of the teeth of the upper fixed jaw face toward the pivot 26 whereas the front surfaces of the teeth of the lower movable jaw face away from the pivot 26. Thus when the curved portion of the plier is clamped around a workpiece and a rotational force is applied, the front surfaces of the teeth of both jaws will constitute the contact faces through which the rotational force is applied to the workpiece.

The front surfaces of the teeth are at an angle "a" to the primary form center line 48. The primary form center line is the line drawn from the center of the pivot 26 to the point of contact of the tips of the jaws when the jaws are closed, and is approximately parallel to tangents of workpieces of various sizes in the curved portion of the jaws where the workpieces will be gripped by the teeth.

In accordance with the present invention, this angle "a" may be between about 60° and about 110°. Preferably the angle is no greater than about 90° and more preferably it is in the range of 75° to 85°. It will therefore be seen that the front surface of a tooth in contact with a workpiece will be at a small angle to the radius of the workpiece at the point of contact, so that force applied through the front surface of the tooth will be tangential, or nearly so, to the workpiece. This means that a very high proportion of the rotational force applied will be tangential force, tending to cause the workpiece to be rotated in the direction of the force, and only a very small proportion will be radially outward, tending to counteract the gripping force and increase the likelihood of slipping.

If the angle between the front face and the tangent to the workpiece at the point of contact is 90°, then 100% of the applied force will result in torque on the workpiece. If this angle is 80° or 100°, the percentage converted to torque reduces to 98.5%, at 70° or 110°, 94% of the applied force appears as torque, and at 60° approximately 87% of the force is converted to torque. A reverse angle tooth (greater than 90°) has the advantage of a greater tendency to penetrate the surface of the workpiece as the rotational force is applied and thereby prevent slipping, but it also has the disadvantage of resulting in a weaker tooth. Indeed, even a 90° angle may result in a tooth which is weaker than desired. Thus for most applications an angle between 75° and 85° will be preferred.

Although for manufacturing simplicity it is more convenient to have all of the front faces of the teeth at the same angle with respect to the primary form center line, different angles may be used for the faces of different teeth. For example, a smaller angle "a" may be used on the teeth 42 nearest the tip of the lower jaw and on the teeth nearest the base of the upper jaw, while a larger angle "a" may be used on the teeth near the base of the curved portion of the lower jaw and the teeth near the tip of the curved portion of the upper jaw. Alternatively, the contact face of the teeth may be made substantially perpendicular to the tangent of the arc of the arcuate segment of the jaw. Either of these alternatives would result in tooth faces more nearly perpendicular to the tangent of the workpiece at the point where the tooth engages the workpiece. As a practical matter, however, this variation in front surface angle is likely to have little noticeable effect upon the operation of the tool, and manufacturing is more difficult.

In order to achieve the desired near tangential force effect with both upper and lower jaw, it is necessary that the front or contact surfaces of the teeth on one jaw face toward the handle whereas those on the other jaw face away from the handle. Thus in the embodiment shown in the drawing, when the plier is gripping a workpiece and a downward force is applied to the handle the front surfaces of the teeth 42 efficiently engage the workpiece to cause it to tend to rotate in a clockwise direction as seen in the drawing. If it is desired to apply maximum rotational force to the workpiece in the opposite direction, the plier must be released, turned over and re-clamped on the workpiece in the opposite direction before applying the rotational load.

The back faces of the teeth are cut at an angle sufficient to provide adequate tooth strength and also adequate tooth depth. As in the embodiment shown in the drawing, all teeth need not have the same back face angle. It has been found that in most cases adequate tooth strength can be obtained when the included angle "b" of the tooth is within the range of about 45° to about 90°. To a lesser extent, the advantages of this invention may also be obtained with larger or smaller included angles.

Figure 2:
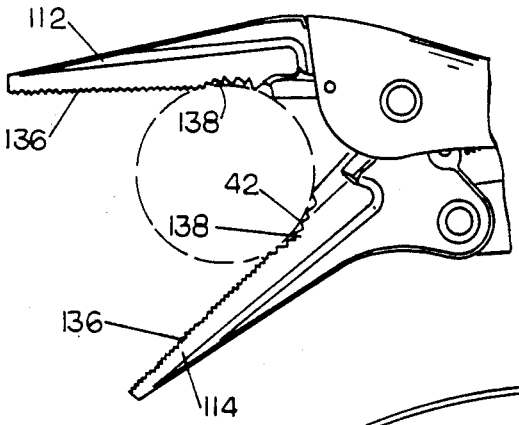
FIG. 2 is a fragmentary elevational view of another locking plier utilizing an embodiment of the invention.

Another embodiment of the invention is shown in FIG. 2, which illustrates the application of the novel tooth form to a long nose locking plier. In this embodiment, the opposed gripping faces 112, 114 have comparatively long straight segments 136 at the outer portions of the jaws and a shorter curved segment 138 between the straight segment and the base of each jaw. As in the previous embodiment, the curved segment is provided with non-symmetrical teeth 42.

The operation of the locking pliers of this invention will be apparent to those of ordinary skill in the art. To grip a workpiece, the adjustment screw 20 is rotated to open the jaws to slightly smaller than the work to be grasped. The jaws are then placed around the workpiece as shown in the drawing, for applying rotative force in the direction of the arrow in FIG. 1, and the handles are gripped to bring the jaws into contact with the workpiece. When firm contact has been made, additional gripping force is applied until the toggle link moves past center, locking the plier jaws on the workpiece. If the jaws are too tight or too loose, they may be released by lifting the free end of the lever 30 with a finger of the hand gripping the pliers. This causes the cam 33 to bear against the toggle link and the lower handle 14, moving the handle downwardly and moving the toggle link past center, to release the jaws from the workpiece. The tightness of the jaws may then be adjusted with the adjustment screw, and they may be reapplied to the workpiece. When the jaws are properly clamped on the workpiece, a rotative force is applied in the direction of the arrow in FIG. 1. If rotation is required in the opposite direction, it is necessary to turn the plier over so that the asymmetric teeth engage the workpiece in the opposite direction. Disengagement is effected as before, with a lifting force applied to the end of the lever 30 by a finger of the hand gripping the plier.

Although various embodiments of the invention have been shown and described herein, the invention is not limited to these specific embodiments. Those skilled in the art may, upon review of the foregoing disclosure or observation of commercial embodiments of the invention, conceive of other variation and arrangements which utilize the invention. It is, therefore, intended to cover as a part of the invention all variations which come within the scope of the appended claims.

I claim:

1. In a locking plier comprising a pair of opposed pivotable work-gripping jaws, a handle, and camming means for camming the jaws to a locked condition on a workpiece, said jaws comprising a straight tip portion on each jaw, facing curved portions on each jaw between the tip and the pivot, and transverse work-gripping teeth in the curved portion of each jaw, a line from the pivot to the point of contact of the tips of the jaws when the jaws are closed forming a primary form centerline, and each tooth having opposing faces, the improvement in which the faces of the teeth in the curved portion of one jaw which face toward the handle comprise front faces which are at substantially the same angle of from about 75° to about 85° to the primary form centerline, the faces of the teeth in the curved portion of the other jaw which face away from the handle comprise front faces which are at substantially the same angle to the primary form centerline as the aforesaid front faces, and the opposite faces of the teeth are all at substantially the same angle of from about 45° to about 90° to the front face.

2. A locking plier as defined by claim 1 in which the curved portion of each jaw includes an arcuate segment and a transitional reverse curved segment merging the straight segment and the arcuate segment.

* * * * *